US006274199B1

(12) United States Patent
Preston et al.

(10) Patent No.: US 6,274,199 B1
(45) Date of Patent: Aug. 14, 2001

(54) WOOD TREATMENT PROCESS

(75) Inventors: Alan F. Preston; Futong Cui; Andrew R. Zahora, all of Charlotte, NC (US)

(73) Assignee: Chemical Specialties, Inc., Charlotte, NC (US)

( * ) Notice: Subject to any disclaimer, the term of this patent is extended or adjusted under 35 U.S.C. 154(b) by 0 days.

(21) Appl. No.: 09/232,972

(22) Filed: Jan. 19, 1999

(51) Int. Cl.[7] ..... B27K 3/00; B27K 3/08

(52) U.S. Cl. ..... 427/298; 427/297; 427/440; 427/441; 428/541

(58) Field of Search ..... 424/405; 427/440, 427/441, 294, 297, 298; 428/541

(56) References Cited

U.S. PATENT DOCUMENTS

| | | | | |
|---|---|---|---|---|
| 3,378,381 | | 4/1968 | Dragnov et al. . | |
| 3,832,463 | | 8/1974 | Nicholson . | |
| 3,945,835 | | 3/1976 | Clarke et al. . | |
| 4,085,251 | * | 4/1978 | Rak | 428/485 |
| 4,407,076 | * | 10/1983 | Estberg | 34/331 |
| 4,464,848 | * | 8/1984 | Estberg | 34/92 |
| 4,486,475 | * | 12/1984 | Shutov et al. | 427/351 |
| 4,612,255 | * | 9/1986 | Hein | 428/541 |
| 4,643,860 | * | 2/1987 | Knudson et al. | 264/109 |
| 5,013,748 | | 5/1991 | Radtke et al. . | |
| 5,468,284 | * | 11/1995 | Sturm | 106/2 |

FOREIGN PATENT DOCUMENTS

| | | | |
|---|---|---|---|
| 2179001 | * | 2/1997 | (CA) . |
| 1181246 | * | 2/1970 | (GB) . |
| WO 89/10956 | | 11/1989 | (WO) . |

* cited by examiner

*Primary Examiner*—Robert H. Harrison
(74) *Attorney, Agent, or Firm*—Klauber & Jackson

(57) ABSTRACT

A process for treating a wood substrate with a water-based formulation containing a wax in order to confer water repellency to the substrate comprising the steps of:

(a) placing the substrate in a treatment vessel and reducing the pressure in the vessel to remove air in the pores of the substrate;

(b) contacting the substrate in the vessel, while reduced pressure is present in the vessel, with the formulation to allow the formulation to flow into said pores, said contacting being carried out at a temperature at or above that required to cause the wax to change into a molten state;

(c) applying a positive pressure to the vessel to force the formulation into said pores; and (d) releasing the pressure in the vessel and removing the resultant wood substrate from the vessel.

28 Claims, 1 Drawing Sheet

WOOD TREATMENT PROCESS

FIELD OF THE INVENTION

The invention pertains to a process for imparting water repellency to wood using water-based formulations which may also contain one or more wood preservatives.

BACKGROUND OF THE INVENTION

Processes for imparting water-repellency to wood substrates using water-based formulations, i.e. oil-in-water emulsions, are well known. Generally, such formulations may be applied by dip, brush or spray, but the modern trend is to impregnate the wood by means of a pressure process.

Water repellents have only a slight effect on the rate of absorption of water vapor in timber, but they can be very effective in reducing absorption of liquid water. They have no effect on the equilibrium moisture content of wood. The object of water repellent treatment of wood is to reduce the wettability of the wood surface so that liquid water does not form a coherent film and does not penetrate the surface structure between boards, and especially the permeable end grain. The process of the invention results in conferring superior water repellency to wood, thereby preventing the absorption of liquid water and providing a degree of dimensional stability and preventing rapid swelling and shrinkage during wetting and drying and is also effective in reducing the rate of mechanical degradation, surface checking and cracking in treated wood during initial drying or in service.

Typically, wood preservatives such as salts based on copper-chromium-arsenic are incorporated in the water-based formulations which provide water repellency to the wood in order to also impart resistance to fungal or insect attack to the wood.

Since the water-based formulations are emulsions of the oil-in-water type, the formulations will contain one or more surfactants to provide stability to the emulsion. Typically, such emulsions will contain one or more surfactants of the nonionic type.

Prior art processes for imparting water repellency to lumber generally are satisfactory when the lumber is derived from a species such as Southern Yellow pine or Radiata pine. However, prior art processes for imparting water repellency are unsatisfactory when the lumber is derived from a refractory species such as Ponderosa pine, Jack pine, Scots pine or Hem-fir, since there is an unacceptably low penetration of the water-based formulation (and any preservative that may be contained in the formulation) into such lumber.

The unsatisfactory penetration of water-based water repellent formulations, i.e. oil-in-water emulsions, into refractory wood species was previously believed to be due to the large particle size of the emulsions. However, it has now been discovered that the shear stability of the emulsion is critical to obtain a satisfactory degree of wood penetration, especially in refractory species.

OBJECTS OF THE INVENTION

It is an object of the invention to provide a process and a water-based formulation for imparting superior water repellency to wood.

It is a further object of the invention to provide a process and a water-based formulation for imparting water repellency to refractory wood species.

It is yet another object of the invention to provide for a process and a water-based formulation which has a high degree of shear stability, thereby facilitating penetration of the formulation into the wood substrate.

SUMMARY OF THE INVENTION

The objects of the invention can be achieved by utilizing a water-based formulation containing a wax, a nonionic surfactant, and optionally an anionic surfactant, an amphoteric surfactant, and/or an oil, and treating the wood substrate with such formulation at a temperature at or above that required to cause the wax to change into a molten state.

DETAILS OF THE INVENTION

Figure 1:
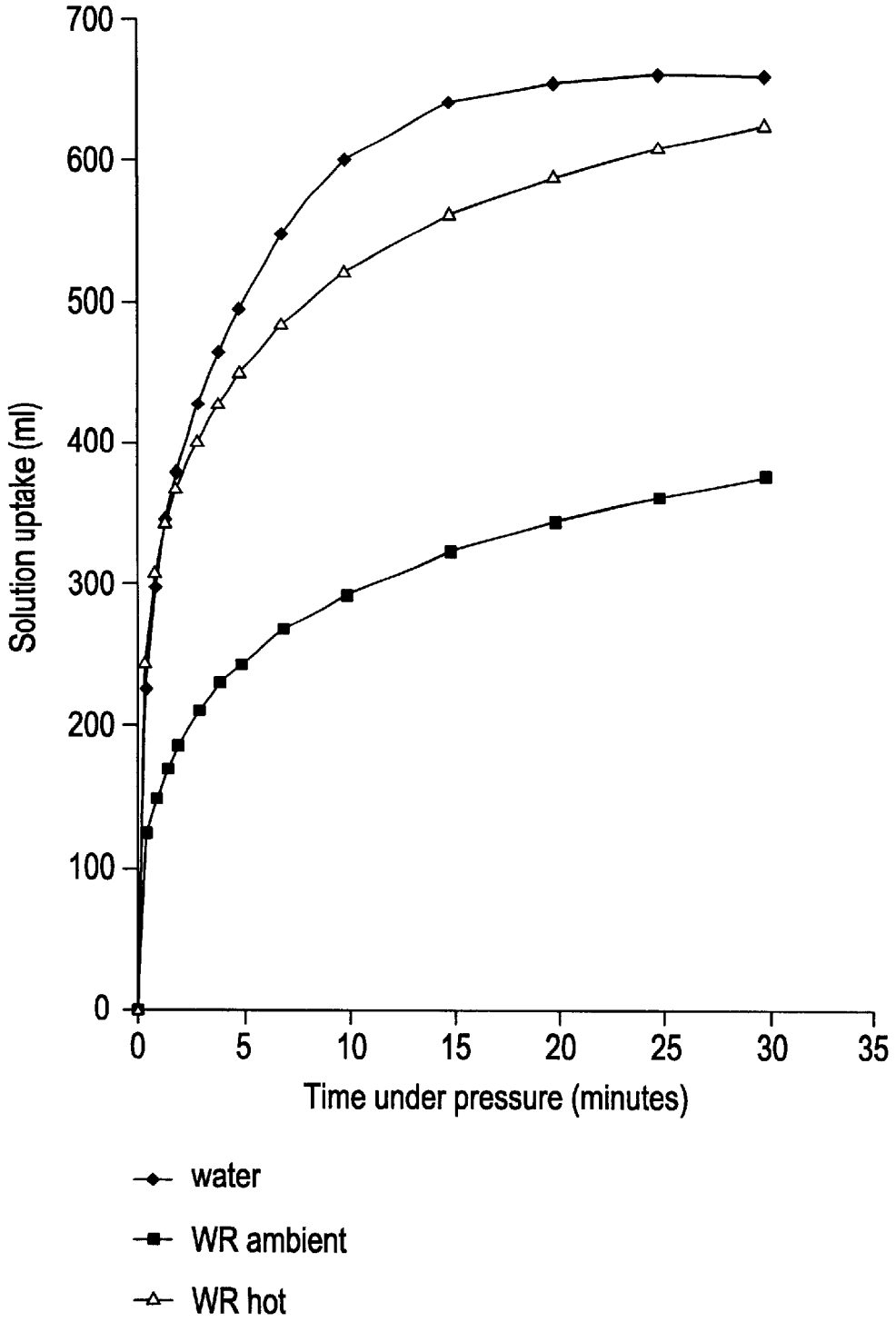
FIG. 1 is a graph which illustrates the solution uptake (ml) in Ponderosa pine lumber of water, water repellent solution applied hot (i.e. 65–75° C.) and the same water repellent solution applied at ambient temperature after the indicated time under pressure (minutes).

In a typical process, the wood substrate will be treated in a process in which the first step comprises the application of an optional initial vacuum (by means of a suitable vacuum pump) to remove the air in the pores of the wood substrate (the wood substrate would have been previously placed in an appropriate treatment vessel). After the desired level of reduced pressure is obtained, the water-based formulation is admitted into the treatment vessel and the formulation is allowed to flow into the wood pores. Thereafter, a positive pressure is applied to the vessel to force the formulation deep into the wood substrate. After the desired amount of the formulation has been injected into the wood substrate, the pressure is released and optionally, a final vacuum is used to remove excess formulation.

In the first step, an initial vacuum of about −50 kPa to −90 kPa is maintained in the vessel for about 5 to 30 minutes to remove air in the pores of the wood. The treatment vessel is then flooded with the formulation while maintaining the vacuum and thereafter, a positive pressure, typically about 350 kPa to 2,000 kPa, e.g. 700 kPa to 1,400 kPa, is applied to the system for about 15–120 minutes to force the formulation into the wood substrate. The pressure is then released and the vessel is drained of treatment solution and an optional final vacuum (e.g. of about −50 kPa to −90 kPa) is applied to remove excess formulation from the wood.

When the formulation flows through the very narrow pores of the wood substrate, the flow is very turbulent, thereby causing shear of the formulation, i.e. the water-based emulsion, which is described in greater detail below. Since wax is present in the emulsion, shearing of the emulsion results in the formation of large wax particles which block the wood pores and prevents further penetration of the formulation into the pores of the wood substrate.

It has been unexpectedly discovered that the formation of large wax particles resulting from shearing of the emulsion may be avoided by carrying out the process of treatment of the wood substrate at a temperature at or above that required to cause the wax present in the emulsion to change into a molten state. The result of using such elevated temperature is that no solid wax particles are formed when the emulsion is sheared as it flows into the pores of the wood substrate. Since the turbulence of the flow of the emulsion over the wood substrate not only causes shear but also causes further desirable emulsification of the emulsion, avoidance of the formation of the solid wax particles allows the benefits of shear to occur without the concurrent disadvantage associated with the formation of solid wax particles.

For the purposes of this invention, the temperature at which the emulsion is applied to the wood substrate is at or above that required to cause the wax present in the emulsion to change into a molten state. Preferably, the temperature is slightly, e.g.about 2 to 10° C., higher than the melting point of the wax present in the emulsion, but preferably not higher than about 90° C. to prevent the water present in the emulsion from flashing off.

The water-based formulations employed in the process of the invention are preferably formulated such that they are stable at the elevated wood treatment temperatures, thereby allowing for penetration of the emulsions into the pores of the wood. It is also desirable that the surfactants chosen for the formulations have the maximum activity at the elevated process temperature, thereby resulting in the formation of emulsions having the lowest possible surface tension.

A unique advantage of the process of the invention is that as a result of the elevated temperature employed in the process, the wood substrate after treatment is hot and drip-free, thereby eliminating contamination of the surrounding environment. When the formulation is employed in conjunction with preservatives such as those described below, the elevated temperature causes rapid fixation of the preservative within the wood substrate, and the wood thereby becomes drip-free after the (optional) final vacuum stage.

It has also been found that the elevated temperature dramatically improves the degree of penetration of the formulation in certain wood species such as Ponderosa Pine. Typically, when the formulation is applied at ambient temperature, the formulation penetrates such species to an insufficient degree. When the process of the invention is employed to treat such wood species, it has been found that the elevated temperature is responsible for a one to four-fold increase in the degree of penetration.

The Formulation

The water-based formulation employed in the process of the invention for conferring water repellency to the wood substrate will contain water, a wax, one or more nonionic surfactants and optionally an anionic surfactant, an amphoteric surfactant and/or an oil. Wood preservatives such as chromated copper arsenate (CCA), azoles, alkaline copper, alkaline copper quaternary salts, alkaline copper zinc arsenates, quaternary ammonium compounds, isothiazolones and carbamates may also be incorporated in the formulation.

The water is present in the amount of about 30–80 wt. %, preferably 40–70 wt. %., based on the weight of the formulation.

The hydrocarbon wax is present in the amount of about 10–50 wt. %, preferably 20–35 wt. %, based on the weight of the formulation. The particular type of wax employed in the water-based formulations of the invention is not critical. Typically, the wax may be a natural or synthetic wax having a weight average molecular weight in the range of about 250–4,000 and a carbon number in the range of about 15–300. Suitably the hydrocarbon wax is a slack wax or a micro-crystalline wax. One advantage of the water-based formulations of the present invention is that the hydrocarbon wax may be an inexpensive slack wax in contradistinction to prior art formulations such as those described in U.S. Pat. No. 3,832,463 in which impure slack waxes and petroleum jelly were deemed to be undesirable because of their low solubility in aliphatic and aromatic solvents employed in the formulations of the '463 patent, thereby leading to thick gels even when employed in relatively low concentrations.

At least one nonionic surfactant is present in the water-based formulation in the amount of about 0.5–10 wt. %, preferably 2–6 wt. %, based on the weight of the formulation. Typically, the nonionic surfactant will comprise a hydrophobic chain, with the chain being a straight or branched chain $C_8$–$C_{18}$ aliphatic hydrocarbon, a $C_8$–$C_{18}$ alkylated phenol or a $C_8$–$C_{18}$ aliphatic fatty acid. The nonionic surfactant will typically have a degree of ethoxylation in the range of about 5–100 and an HLB in the range of about 10–19. The particularly preferred nonionic surfactant comprises an ethoxylated lauryl alcohol or nonylphenol having a degree of ethoxylation in the range of 7–50.

An anionic surfactant may be present in the water-based formulation in the amount of about 0–10 wt. %, preferably 1–3 wt. %, based on the weight of the formulation. The preferred anionic surfactant has the general formula $C_nH_{2n+1}SO_3M$, wherein n is an integer of 8–12 and M is selected from the group consisting of sodium, calcium and ammonium. A particularly preferred anionic surfactant is calcium dodecylbenzenesulfonate.

An amphoteric surfactant may be present in the water-based formulation in the amount of about 0–10 wt. %, preferably 0.3–1.5 wt. % based on the weight of the formulation. The preferred amphoteric surfactant has the general formula $C_nH_{2n+1}(CH_3)_2NO$, $C_nH_{2n+1}N^+(CH_3)_2CH_2COO^-$ or $C_nH_{2n+1}N^+(CH_3)_2CH_2SO_3^-$, wherein n is an integer of 8–18. A particularly preferred amphoteric surfactant is decyl dimethyl amine oxide.

A oil may be present in the water-based formulation to the extent of about 0–30 wt. %, preferably 5–15 wt. %, based on the weight of the formulation. Suitable oils include aliphatic petroleum distillates, aromatic kerosene extracts and vegetable oils. Preferably, the oil is a hydrocarbon oil known as "neutral oil".

The water-based formulation may also contain a wood preservative in the amount of about 0.1 to 10 wt. %, based on the weight of the formulation, in order to impart resistance to fungal and insect attack, as well as water repellency, to the wood. Suitable wood preservatives include, but are not limited to, chromated copper arsenate (CCA); azoles such as hexaconazole, propiconazole, tebuconazole, cyproconazole, dinaconazole and mixtures thereof; alkaline copper; alkaline copper quaternary salts such as alkaline copper didecyl dimethyl ammonium chloride; alkaline copper zinc arsenates; copper azoles (mixture of alkaline copper and various azoles); copper citrate; quaternary ammonium compounds such as didecyl dimethyl ammonium chloride and N-alkyl ($C_8$–$C_{18}$) dimethyl benzyl ammonium chloride; isothiazolones such as 4,5-dichloro-2-n-octyl-4-isothiazoli-3-one; tributyl tin oxide; and 3-iodo-2-propynyl butyl carbamate.

The water-based formulations employed in the process of the invention may be prepared by a variety of techniques used in preparing wax-based emulsions, such as homogenization. Typically, the components are mixed and heated to a temperature above the melting point of the wax. If the wax has a melting point of about 100° C. or higher, a pressure vessel is typically employed to prevent the water from flashing off. Preferably, the process conditions are such that the particle size of the emulsion is less than about 0.4 $\mu$m.

Typically, one part of the water-based formulation is diluted with 20 to 120 parts of water to form a treatment solution. The wood substrate which can be treated with the water-based formulations in accordance with the process of the invention include those varieties which are commonly treated with preservatives such as Southern Yellow Pine, Ponderosa Pine, Scots Pine, Hem-Fir, Red Pine, Jack Pine, Lodgepole pine, Radiata pine, Japanese pine, Hoop pine, red wood and cedar.

The following nonlimiting examples illustrate the process of the invention in the treatment of wood substrates to confer water repellency using water-based formulations of the type described above. Unless otherwise indicated, all parts and percentages are expressed on a weight basis.

The formulations described in Examples 1–4 were prepared by the following general procedure: All ingredients were mixed and heated to 850° C. and stirred, e.g. by a mixer such as a Ross mixer, to yield a milky-white crude emulsion. While maintaining the 850° C. temperature, the crude emulsion was then processed on a two-stage homogenizer (set to 4,000–5,000 psi for the first stage and 800–1,000 psi for the second stage) and cooled immediately to ambient temperature using a cooling coil. After processing, but before cooling, the emulsion could be processed by a second pass in the homogenizer in order to achieve the desired particle size. With double-pass processing, the particle sizes of the emulsions were in the range of 180–220 nm.

EXAMPLE 1

A formulation was prepared from the following ingredients:

| | |
|---|---|
| Nonylphenoxypoly (ethyleneoxy) ethanol (100 moles of ethylene oxide) | 3.89 wt. % |
| Nonylphenoxypoly (ethyleneoxy) ethanol (15 moles of ethylene oxide) | 1.85 wt. % |
| Sodium dodecylbenzenesulfonate | 0.44 wt. % |
| Slack wax | 25.0 wt. % |
| Neutral Oil | 7.5 wt. % |
| Water | 61.32 wt. % |

EXAMPLE 2

A formulation was prepared from the following ingredients:

| | |
|---|---|
| Nonylphenoxypoly (ethyleneoxy) ethanol (100 moles of ethylene oxide) | 2.4 wt. % |
| Nonylphenoxypoly (ethyleneoxy) ethanol (15 moles of ethylene oxide) | 1.14 wt. % |
| Calcium dodecylbenzenesulfonate | 2.64 wt. % |
| Slack wax | 25.0 wt. % |
| Neutral Oil | 7.5 wt. % |
| Water | 61.32 wt. % |

EXAMPLE 3

A formulation was prepared from the following ingredients:

| | |
|---|---|
| Nonylphenoxypoly (ethyleneoxy) ethanol (15 moles of ethylene oxide) | 3.0 wt. % |
| Poly (ethyleneoxy) lauryl ether (15 moles of ethylene oxide) | 4.0 wt. % |
| Slack wax | 25.0 wt. % |
| Neutral Oil | 7.5 wt. % |
| Water | 60.5 wt. % |

EXAMPLE 4

A formulation was prepared from the following ingredients:

| | |
|---|---|
| Poly (ethyleneoxy) lauryl ether (15 moles of ethylene oxide) | 4.0 wt. % |
| Decyl dimethyl amine oxide | 1.22 wt. % |
| Slack wax | 25.0 wt. % |
| Neutral Oil | 7.5 wt. % |
| Water | 62.28 wt. % |

EXAMPLE 5

A typical wood treatment solution is prepared by adding 3 wt. % of a water repellant formulation such as one of those described in Examples 1–4 to a solution containing about 0.15 wt. % preservative such as propiconazole. Ponderosa pine is placed in an insulated treatment vessel that is pre-heated to about 65–75° C. Pressure in the vessel is then reduced to −95 kPa to −80 kPa for about 15–30 minutes. The vessel is then flooded with the wood treatment solution pre-heated to about 65–75° C., while under vacuum. Thereafter, a pressure of about 1,000 kPa is applied to the vessel for about 15–120 minutes. The pressure is then released and the wood treatment solution is drained from the vessel. A final vacuum of about −90 kPa is applied for 15–30 minutes to remove excess solution and the treated wood is then allowed to dry.

In general, an emulsion-based water repellent formulation can significantly reduce the treatability of wood, particularly a refractive species such as Ponderosa pine. The advantage of carrying out the treatment process at a temperature of 65–75° C. is illustrated in FIG. 1. Although the water repellent solution applied at ambient temperature resulted in a poor solution uptake, a good solution uptake approaching that afforded by water alone was achieved by applying the water repellent solution at the temperature of 65–75° C.

The wood treatment solution employed in the example was that of Example 1. Data in FIG. 1 were obtained by treating end-matched, end-sealed Ponderosa pine of 89 mm×38 mm×279 mm in a small treatment vessel with a sight glass which allows monitoring of solution uptake.

What is claimed is:

1. A process for the treatment of a wood substrate in order to confer water repellency to the substrate, which comprises the steps of:

(a) placing the said wood substrate in a treatment vessel and reducing the pressure in the vessel to remove air in the pores of said substrate;

(b) contacting the substrate in said vessel, while reduced pressure is present in the vessel, with an emulsion comprising water, wax, and a surfactant to allow the emulsion to flow into said pores, said contacting being carried out at a temperature at or above that required to cause the wax of said emulsion to change into a molten state;

(c) applying a positive pressure to said vessel to force the emulsion into said pores; and (d) releasing the pressure in the vessel and removing said resultant wood substrate from said vessel.

2. The process of claim 1, wherein the temperature in step (b) is in the range of about 2 to 10° C. higher than the melting point of the wax, but is less than about 90° C.

3. The process of claim 1, wherein the reduced pressure in step (b) is in the range of about −50 kPa to −90 kPa.

4. The process of claim 1, wherein in step (d), a reduced pressure is applied to the vessel to remove excess formulation prior to removal of said wood substrate from the vessel.

5. The process of claim 4, wherein the reduced pressure in step (d) is in the range of about −50 kPa to −90 kPa.

6. The process of claim 1, wherein the positive pressure in step (c) is in the range of about 350 to 2,000 kPa.

7. The process of claim 1, wherein the positive pressure in step (c) is in the range of 700 to 1,400 kPa.

8. The process of claim 1, wherein the formulation comprises:

(i) about 30–80 wt. %, based on the weight of said emulsion, of water;

(ii) about 10–50 wt. %, based on the weight of said emulsion, of a hydrocarbon wax;

(iii) about 0.5–20 wt. %, based on the weight of said emulsion, of at least one nonionic surfactant;

(iv) about 0–10 wt. %, based on the weight of said emulsion, of an anionic surfactant;

(v) about 0–10 wt. %, based on the weight of said emulsion, of an amphoteric surfactant; and (vi) about 0–30 wt. %, based on the weight of said emulsion, of an oil.

9. The process of claim 8, wherein the water is present in an amount of 40–70 wt. %.

10. The process of claim 8, wherein the wax is present in an amount of 20–35 wt. %.

11. The process of claim 8, wherein the oil is present in an amount of 5–15 wt. %.

12. The process of claim 8, wherein the nonionic surfactant is present in an amount of 2–6 wt. %.

13. The process of claim 8, wherein the anionic surfactant is present in an amount of 1–3 wt. %.

14. The process of claim 8, wherein the amphoteric surfactant is present in an amount of 0.3–1.5 wt. %.

15. The process of claim 8, wherein the nonionic surfactant comprises a hydrophobic chain, said chain being selected from the group consisting of a straight or branched chain $C_8$–$C_{18}$ aliphatic hydrocarbon, a $C_8$–$C_{18}$ alkylated phenol and a $C_8$–$C_{18}$ aliphatic fatty acid.

16. The process of claim 14, wherein the nonionic surfactant has a degree of ethoxylation in the range of about 5–100 and an HLB in the range of about 10–19.

17. The process of claim 16, wherein the nonionic surfactant comprises an ethoxylated lauryl alcohol or nonyl phenol having a degree of ethoxylation in the range of 7–50.

18. The process of claim 8, wherein the anionic surfactant has the general formula $C_nH_{2n+1}SO_3M$, wherein n is an integer of 8–12 and M is selected from the group consisting of sodium, calcium and ammonium.

19. The process of claim 18, wherein the anionic surfactant comprises calcium dodecylbenzenesulfonate.

20. The process of claim 8, wherein the amphoteric surfactant has the general formula $C_nH_{2n+1}(CH_3)_2NO$, $C_nH_{2n+1}N^+(CH_3)_2CH_2COO^-$ or $C_nH_{2n+1}N^+(CH_3)_2CH_2SO_3^-$, wherein n is an integer of 8–18.

21. The process of claim 20, wherein the amphoteric surfactant comprises decyl dimethyl amine oxide.

22. The process of claim 8, wherein the hydrocarbon wax is a natural or synthetic wax having a weight average molecular weight in the range of about 250–4,000 and a carbon number in the range of about 15–300.

23. The process of claim 22, wherein the hydrocarbon wax comprises a slack wax or a micro-crystalline wax.

24. The process of claim 22, wherein the hydrocarbon wax is a slack wax.

25. The process of claim 8, wherein the oil is selected from the group consisting of an aliphatic petroleum distillate, an aromatic kerosene extract and a vegetable oil.

26. The formulation of claim 8, wherein the oil is the hydrocarbon oil known as neutral oil.

27. The process of claim 8 further comprising about 0.1 to 10 wt. %, based on the weight of the formulation, of a wood preservative selected from the group consisting of CCA, azoles, alkaline copper, alkaline copper quaternary salts, alkaline copper zinc arsenates, quaternary ammonium compounds, isothiazolones and carbamates.

28. The process of claim 27, wherein the azole is selected from the group consisting of hexaconazole, propiconazole, tebuconazole, cyproconazole, dinaconazole and mixtures thereof.

* * * * *